United States Patent [19]

Boxer et al.

[11] 4,058,853

[45] Nov. 22, 1977

[54] SOCKS WITH FLEXIBLE SELF-CONTAINED FASTENER PATCHES

[76] Inventors: Rubin Boxer; Robert Keith Boxer, both of 564 Ricardo Ave., Santa Barbara, Calif. 93109

[21] Appl. No.: 632,818

[22] Filed: Nov. 17, 1975

Related U.S. Application Data

[63] Continuation-in-part of Ser. No. 617,969, Sept. 29, 1975, abandoned.

[51] Int. Cl.[2] ..... A41B 11/00

[52] U.S. Cl. ..... 2/239; 2/DIG. 6; 24/204; 24/DIG. 18; 24/DIG. 29; 428/101

[58] Field of Search ..... 2/239, 240, DIG. 6, 2/159, 160, 161 A; 428/101; 24/204, DIG. 29, DIG. 18

[56] References Cited

U.S. PATENT DOCUMENTS

| | | | |
|---|---|---|---|
| 2,663,877 | 12/1953 | Bohman | 2/239 |
| 3,508,280 | 4/1970 | Osborn | 2/159 |
| 3,688,348 | 9/1972 | Klotz et al. | 24/DIG. 29 |
| 3,790,168 | 2/1974 | Hashimoto | 2/161 A |

FOREIGN PATENT DOCUMENTS

| | | | |
|---|---|---|---|
| 635,797 | 1/1928 | France | 2/240 |

*Primary Examiner*—H. Hampton Hunter
*Attorney, Agent, or Firm*—Harry W. Brelsford

[57] ABSTRACT

A pair of socks is held together from the time it is removed for laundering, during washing, and, later, by means of a flexible patch secured to each sock, the patches of a pair adhering to each other when pressed together. A manual pull will separate the socks for use. Flexible hook-and-pile patches are presently preferred inasmuch as their flexibility avoids stretching and tearing the socks during washing. The hook patches are prevented from catching on the trousers or other clothes of the wearer by closing an integral or attached patch of pile to cover these hook patches, and the patches are opened up for additional bonding area with matching hook-and-pile patches on the other sock.

8 Claims, 7 Drawing Figures

SOCKS WITH FLEXIBLE SELF-CONTAINED FASTENER PATCHES

This is a continuation-in-part of our prior application, Ser. No. 617,969, filed Sept. 29, 1975, having the same title, now abandoned.

This invention relates to pairs of apparel items, such as socks, and has particular reference to an improved fastening structure for holding such pairs together as during laundering, etc.

Various attempts have been made over the years to relieve housewives and others of the chore of matching up sock pairs after laundering. Various types of clips have been used to hold pairs together. Others have used pins that pierce both socks of a pair. These have proved unsatisfactory, because they are usually not conveniently available when the wearer discards his socks for the laundry. Other solutions have been sought by using separate pockets in mesh bags which can be bodily immersed in a washing machine. Another attempt is illustrated by U.S. Pat. No. 3,688,348 to Klotz, wherein special bands are wrapped around the shanks of sock pairs to keep them together during washing. Such bands have the same disadvantages of lack of availability at the time of discarding socks.

Other attempts have been made by placing snaps or hook-and-eye fasteners on sock pairs. These, too, have their drawbacks. Snaps and hook-and-eye fasteners are usually metallic or otherwise stiff and unyielding as the socks are tugged and pulled during washing. This tends to increase local stresses, resulting in local stretching near the fasteners and sometimes tearing the sock fabric. Also, they have a more serious disadvantage of being uncomfortable to the wearer if local pressure is placed on the sock as by crossing the legs. This causes the stiff fasteners to press into the flesh, and this pressure becomes uncomfortable. In the case of metallic mechanical fasteners, bending and deformation can sometimes occur in severe washing.

Another attempt has been made with the use of tie strings. While these, too, are instantly available if sewed to sock pairs, they are cumbersome and have proved to be unsatisfactory.

We have found a combination of socks and self-contained fasteners that operates satisfactorily. We found that the objections to prior art fasteners can be avoided by the use of flexible patches that can be placed directly on the socks and which patches adhere to each other when pressed together. While several materials fall into this category, we presently prefer fasteners of the hook-and-pile type generally sold under the trademark of Velcro and described in U.S. Pat. No. 3,000,384 and 3,009,235. This type of fastener holds up in repeated washings, even with very hot water, and retains its holding power over long periods of time. Flexible sticky patches to accomplish this same result give difficulty in having other garments stick to the patches, and the patches lose their stickiness with repeated washings. The hook-and-pile material presently preferred is very flexible and comes in sheets or strips that can be cut to size and then adhered or sewn to the socks.

The hook patches tend to adhere to some materials such as fuzzy trouser materials and, while this temporary bond is easily broken, it may annoy some users. We have found that this adhering tendency can be avoided by placing a patch of pile material over the hook patch. The pile patch is preferably hinged to the hook patch and can be opened for bonding, which additionally doubles the bonding area.

Various objects, advantages, and features of the invention will be apparent in the following description and claims considered together with the drawings forming an integral part of this application and in which:

Figure 1:
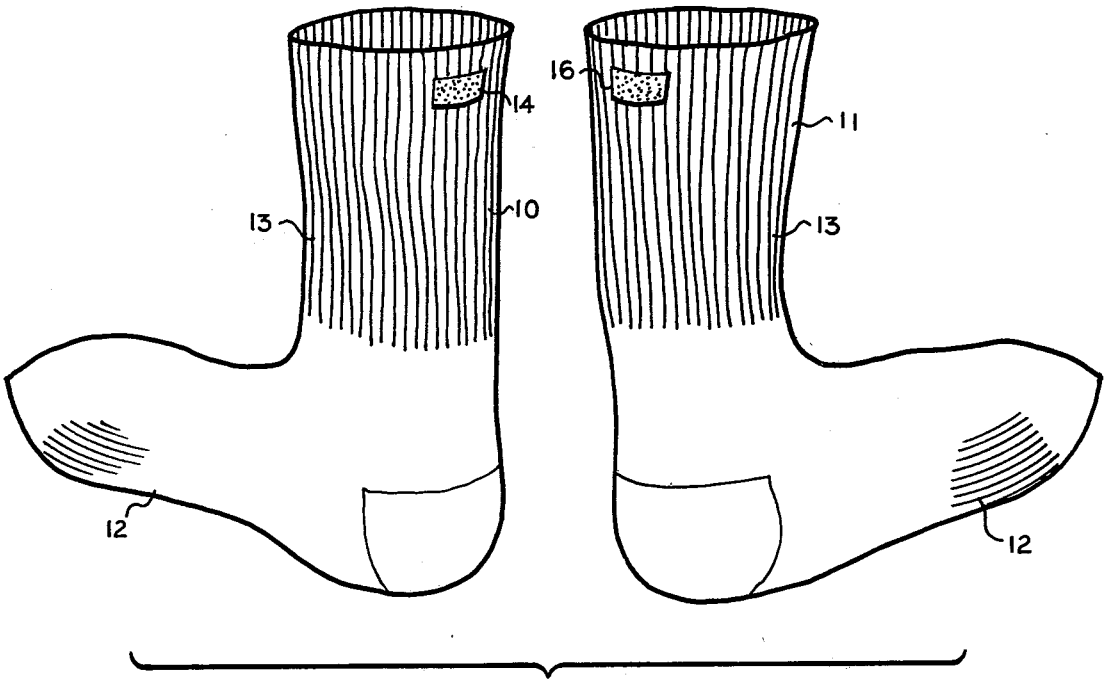
FIG. 1 is a three-dimensional view of a pair of separated socks having fastener patches secured to the socks.

Referring to FIG. 1, there is illustrated a pair of socks 10 and 11, each having a foot section 12 and a shank section 13. Disposed on each sock 10 and 11 are fastener patches 14 and 16, respectively. These patches may be placed anywhere on the sock for the purpose of holding a sock pair together, but we have determined that there is a minimum interference with pant legs and minimum visibility if the patches 14 and 16 are placed at the rear of the shank and toward the top of the shank.

The patches 14 and 16 are selected particularly in accordance with our invention to be flexible, and the closer the patch material can approach the flexibility of the fabric of the socks, the more effective are the patches. If stiff fasteners such as snaps are used, the sock fabric is stretched out of shape and sometimes torn. Our flexible fastener patches, by contrast, flex with the sock fabric during washing and thereby prevent such local stresses. Furthermore, our flexible patches are comfortable to the wearer, and local pressure on the legs will not produce painful impressions, but instead will be smooth and comfortable.

Figure 2:
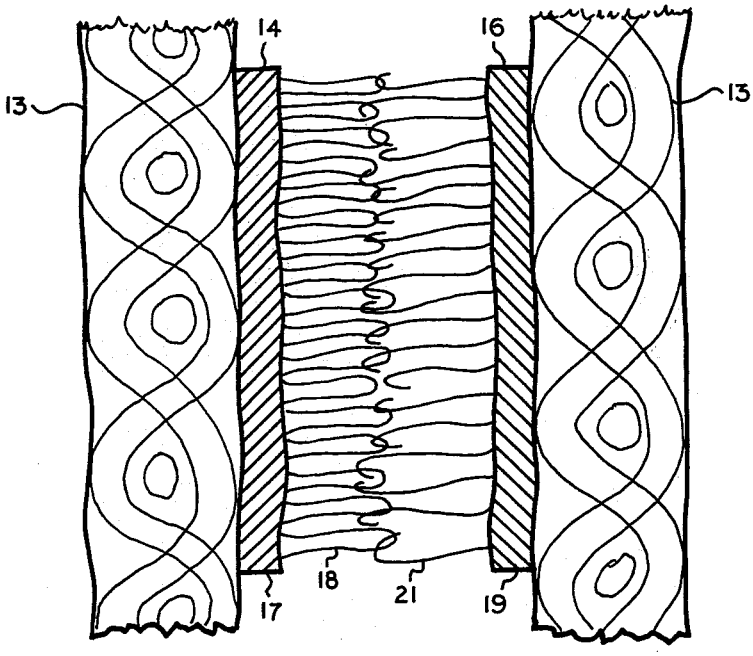
FIG. 2 is a sectional view through the fabric of the socks and the patches when the patches are secured together, thereby holding the socks of the pair.

While various types of flexible adhering patches 14 and 16 can be used, we have found that the most durable and satisfactory is the hook-and-pile type previously mentioned, sold under the trademark "Velcro." This type of material has mating halves with hooks on one part and pile on the other. When manually pressed together, they adhere with good pressure per square inch so that a rather strong tug is required to separate them. Such a structure is shown in enlarged section in FIG. 2, wherein the patch 14 consists of a flexible base 17 from which projects pile 18. The patch 16 consists of a flexible base 19 from which project hooks 21. The hooks engage the pile when pressed together to hold the two patches together and thereby hold the socks together.

Various means may be employed to secure the patches 14 and 16 to the sock shanks 13. We have used sewing with good results. Coating the surfaces of bases 17 and 19 with a thermoplastic permits ironing the patches to the socks, especially when the hooks and pile are joined together. Cold adhesives can be used, particularly flexible epoxy cements.

We have found that when socks are washed with heavy items such as sheets and towels in an automatic or other power washer, considerable stress is placed on the patches 14 and 16. We have used patches of about one-quarter to one-half square inch successfully.

We have found that the hook patches of one sock tend to momentarily stick to the user's trousers, especially if the trouser material is very fuzzy. For example, if the wearer of such trousers happens to cross his legs to place pressure on the exposed hooks of the hook patch, there is a weak adherence of the fuzzy material to the hook patch. While this bond is easily broken, it may become annoying to some. We have found that this can be avoided by placing a cover over the hook patch. This cover can be of a material that sticks to the hooks. We have found, however, that the best results are obtained by using a cover of pile material from the hook-and-pile combination. To make sure that this cover is always available, we connect it directly to the hook patch. With this objective, the cover is hinged to the hook patch, but can be joined in any other fashion. When the cover is closed on the hooks, only the smooth fabric backing of the cover is exposed and trousers do not stick to it.

We have further found that both socks of a pair can be provided with a hook patch and a pile cover, and when both are opened up to expose both cover and patch, the hooks of one sock can engage the pile of the other and vice versa, to double the bonding area when the two socks are joined together for laundering, etc. In this fashion, for example, a quarter square inch of hook patch can have a quarter square inch of pile cover hinged to it to provide half a square inch of joining surface. As mentioned previously, we presently prefer about one-quarter to one-half square inch of joining surfaces to withstand the rigors of clothes-washing machines.

It will be apparent that it is immaterial which of a hinged pair of hook-and-pile patches is secured to the socks and which is the cover for the other. We presently prefer to secure the pile to the sock, in which case the hinged area of hooks becomes the "cover."

Figure 3:
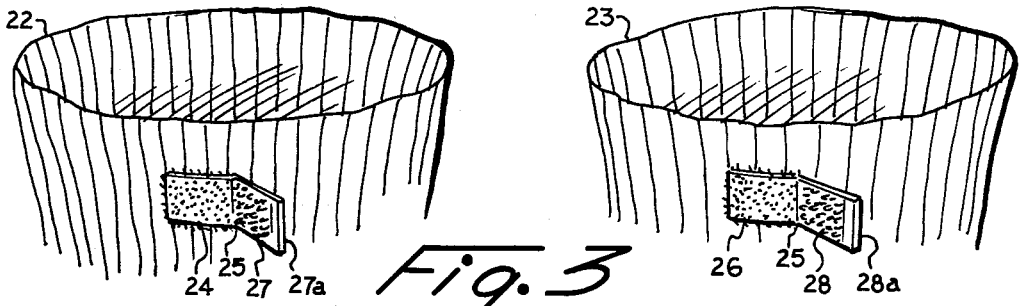
FIG. 3 is a three-dimensional fragmentary view of the tops of a pair of socks, each having a pile and hook patch joined together, one of which is fastened to each sock.
Figure 4:
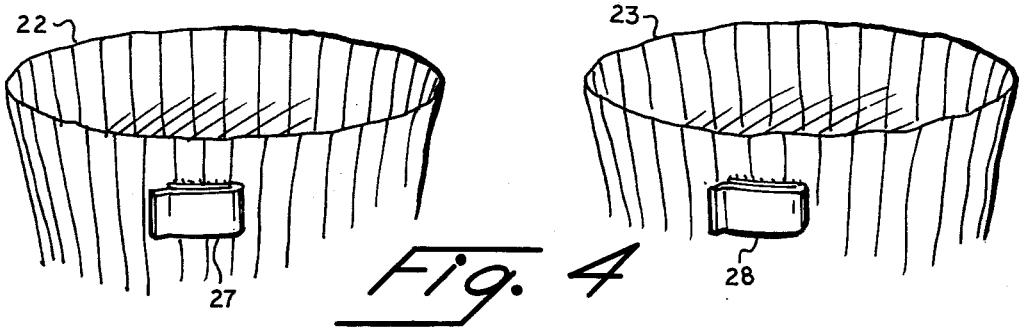
FIG. 4 is a three-dimensional fragmentary view of the sock tops of FIG. 3 showing the top closed upon the secured patch to present a smooth fabric exterior for each hook-and-pile pair.
Figure 5:
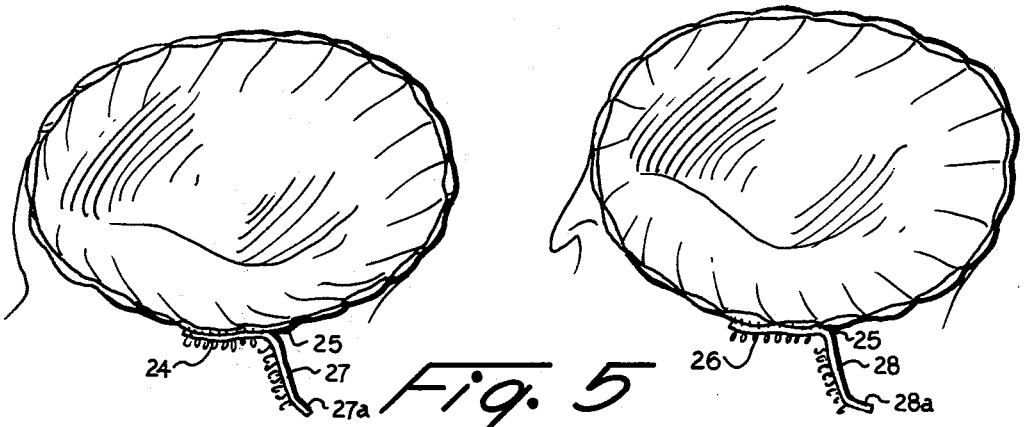
FIG. 5 is a top view of the socks of FIG. 4, showing the hinged or integral relationship of each hook-and-pile pair.

Referring to FIGS. 3, 4, and 5, secured to each sock 22 and 23 of a pair of socks is a patch of pile 24 and 26, respectively. Hinged at 25 to pile patches 24 and 26 are hook patches 27 and 28, respectively. The hinge may be formed of the fabric backing upon which the pile and hooks are woven, or the hook patches 27 and 28 may be sewed to the pile patches, in which case the threads may act as the hinge or part of the hinge. The outermost edge of the hook patches 27 and 28 may be free of hooks as at 27*a* and 28*a*. This gives a nonadhering part of the hook patch, which may be grasped by the user to pull the patch pairs 24–27 and 26–28 apart. The provision of such a tab is optional.

FIG. 3 shows the patch pairs 24–27 and 26–28 opened up as for joining the socks together for laundering. In this event the hook patch 28 of sock 23 is joined to the pile patch 24 of sock 22 and the pile patch 26 of sock 23 is joined to the hook patch 27 of sock 22. The hinged nature of the patch pairs 24–27 and 26–28 is illustrated in FIG. 5 in a partly closed condition. When each patch pair 24–27 and 26–28 is adhered to itself, the condition is shown in FIG. 4, and only the fabric backing of hook patches 27 and 28 is visible. This fabric backing is smooth and will not catch on clothing. The closed patch pairs 24–27 and 26–28 are fairly flexible and will conform to the curvature of the wearer's legs.

Figure 6:
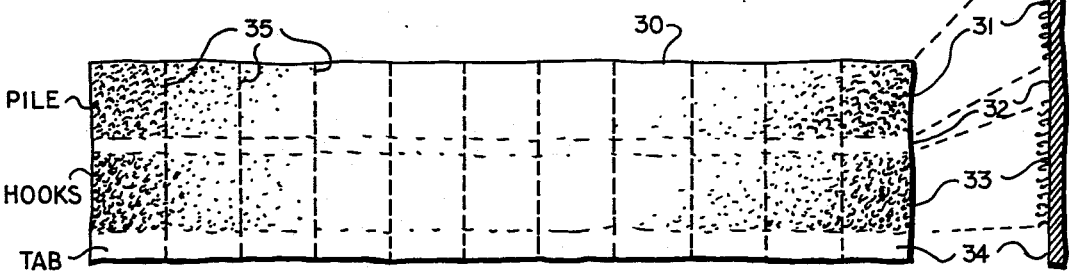
FIG. 6 is a plan view of a strip of material having hook structures on one linear part and pile structures on the other linear part, so that the strip can be transversely cut to form the hook-and-pile pairs of FIGS. 3, 4, and 5.
Figure 7:
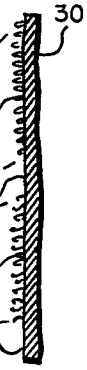
FIG. 7 is an end view on an enlarged scale of the strip of FIG. 6.

Illustrated in FIGS. 6 and 7 is a presently preferred type of factory-made strip from which our patch pairs 24–27 and 26–28 may be formed. A single flexible fabric backing 30 has pile structures 31 sewn or otherwise embedded in the upper part of this fabric strip. Adjoining this pile part is a clear longitudinal area 32, which acts as the hinge area. Adjoining the hinge strip 32 is a lower longitudinal area 33 in which are sewn or otherwise embedded the hook structures of the hook-and-pile combination. The lower edge of the fabric 30 is kept clear to form a tab strip 34.

The factory-made strip of FIGS. 6 and 7 is cut transversely along broken lines 35 to form the pile-hook pairs 24–27 and 26–28 of FIGS. 3, 4, and 5, of any desired width.

OPERATION OF FIGS. 3 THROUGH 5

Referring to FIG. 5, the wearer of the socks 22 and 23 closes the hook patches 27 and 28 on the pile patches 24 and 26 by rotating them clockwise about their hinge strips 25. The clear fabric backing of the hook patches is then outermost as shown in FIG. 4, and these smooth outer fabrics of patches 27 and 28 will not catch on the pant legs or other clothing of the user.

When the user removes his socks 22 and 23, he manually grasps the tab areas 27*a* and 28*a* (FIGS. 3 and 5) of the patches 27 and 28 and gives a smart pull, which then separates them from the pile patches 24 and 26. They are then in the open position shown in FIG. 3. The user then pushes the patches of the two socks together, hook patch 28 joining with pile patch 24 and hook patch 27 joining with pile patch 26. The socks can then be laundered and after laundering and drying will still be joined together. They can then be placed in the dresser drawer.

When next it is desired to use them, the tabs 27*a* or 28*a* of one sock are manually grasped and pulled while holding onto the other sock. The patches then are separated and the socks are ready for wearing after closing patches 27 and 28 as described above.

In addition to avoiding the chore of sock matching after laundering, our flexible patches serve to keep sock pairs and glove pairs, etc., together in dressers without the necessity of wadding one inside the other or using other holding techniques. Our patches are useful to the manufacturer also in avoiding the necessity for packing or clipping each pair to hold the two socks together.

We have described the presently preferred form of our improvement as required by the Rules. We do not limit ourselves to this disclosure as various modifications and variations will occur to those skilled in the art. The following claims include all such modifications and variations that fall within the true spirit and scope of the invention.

We claim:

1. In the combination of a pair of flexible clothing items and self-contained fasteners secured to each item of the clothing pair, the improved fasteners comprising:

a strip having cooperating adjacent pair of flexible hook-and-pile patches for each item of the clothing pair, one of said patches having said hooks and the other of said patches having said pile, wherein one of the patches is secured to its associated clothing item and the other joined patch is free from said securement and is selectively; and movable to close over the one patch when the clothing item is being worn by the user to prevent clothing of the wearer from catching on the hooks, said hook-and-pile pair of patches being manually openable so that the patch pair hook-and-pile pair of patches of one clothing item can join with the hook-and-pile pair of patches of the other clothing item of the clothing pair, to hold the items together when they are not being worn.

2. The fasteners of claim 1 wherein both patches of a hook-and-pile pair are formed on a continuous piece of flexible backing, and the flexible backing joins the two patches together and acts as a hinge.

3. In the combination of a pair of fabric socks and a self-contained fastener secured to each sock to engage each other to hold a sock pair together when not in use, an improved fastener of the flexible type in the form of a flexible patch of hooks secured to the fabric of one of the socks and a flexible patch of pile secured to the other sock, and the two patches adhere to each other when manually pressed together, whereby said flexible fastener will keep a matched pair of socks together during washing and will bend and flex with the socks during washing and thereby prevent stretching and tearing of the fabric of the socks, characterized by a flexible patch secured to the sock having the hooks to selectively cover the hooks when said socks are being worn, so that the clothing of the user will not catch on the hooks and to selectively uncover the hooks when said socks are to be held together for washing.

4. A pair of items of wearing apparel characterized by a flexible connection securing the items together as a pair when being laundered, stored and the like, and which may be disconnected when the items are to be worn, and which, when disconnected, provides no interference with the wearability of the items or comfort of the wearer, said pair of items including cooperating, flexible fastener means for readily connecting and disconnecting the items of wearing apparel as desired, said fastener means comprising first and second flexible patches respectively carried by the items of wearing apparel, one of said patches having pile and the other having hooks thereon, and means operatively associated with the patch with hooks for permitting the hooks to be covered when the items are being worn so that said hooks are inoperative and for permitting the hooks to be uncovered when the items are to be connected together so that the hooks are operative for cooperation with the pile, whereby said connection between the items will flex and bend with the items during laundering and the like to thereby prevent stretching or tearing of the items, and the items may be worn in a disconnected manner without any interference with their wearability, such as by the hooks catching on other items of clothing, and without discomfort to the wearer.

5. A pair of items of wearing apparel according to claim 4 wherein said means for permitting the hooks to be covered while the items are being worn comprises means hingedly connecting said second patch having hooks thereon to the item of wearing apparel on which it is carried for movement between an open position in which the hooks are exposed for engagement with the pile on said other patch and a closed position in which the hooks are covered so that the hooks will not catch on other items of clothing when the items of wearing apparel are being worn.

6. A pair of items of wearing apparel according to claim 5 including a third patch carried by the item of wearing apparel adjacent to said second patch and having pile on the outer surface thereof so that when said second patch is removed to the closed position the hooks will engage said pile to maintain said second patch in the closed position.

7. A pair of items of wearing apparel characterized by a flexible connection securing the items together as a pair when being laundered, stored and the like, and which may be disconnected when the items are to be worn, and which, when disconnected, provides no interference with the wearability of the items or with the comfort of the wearer, said pair of items including cooperating, flexible fastener means for readily connecting and disconnecting the items as desired, said fastener means comprising flexible patches carried by the respective items, each of said patches having a smooth surface on one face thereof and a first portion having pile thereon and a second portion having hooks thereon on the other face thereof, one of the first and second portions of each of said patches being secured to said items and the other portion being hingedly connected to said secured portion for movement between an open position in which the hooks and pile are exposed for cooperation with the hooks and pile of the other patch and a closed position in which the hooks and pile of each patch engage each other and the smooth surfaces of the patches are exposed, whereby said flexible connection will flex and bend with the items during laundering and the like to thereby prevent stretching or tearing of the items, and the items may be worn in a disconnected manner without any interference with their wearability, such as by the hooks catching on other items of clothing, and without any discomfort to the wearer.

8. A pair of items of wearing apparel according to claim 7 wherein said items are a pair of socks and wherein the portions of said patches secured to said socks comprise the pile portions with said hook portions being hingedly connected to said pile portions for movement between open and closed positions.

* * * * *

UNITED STATES PATENT AND TRADEMARK OFFICE

CERTIFICATE OF CORRECTION

PATENT NO. : 4,058,853
DATED : November 22, 1977
INVENTOR(S) : Rubin Boxer; Robert Keith Boxer It is certified that error appears in the above-identified patent and that said Letters Patent are hereby corrected as shown below:

Column 5, line 1, cancel "; and" the semicolon and word "and".

Column 6, line 18, cancel "removed" and substitute --moved--.

Signed and Sealed this

*Sixth* Day of *June 1978*

[SEAL]

*Attest:*

RUTH C. MASON
*Attesting Officer*

DONALD W. BANNER
*Commissioner of Patents and Trademarks*